United States Patent [19]

Shelver

[11] 4,295,305

[45] Oct. 20, 1981

[54] THERMAL GLASS STRUCTURE AND METHOD FOR FORMING SAME

[76] Inventor: Lyle N. Shelver, 5020 Ambrose Dr., Reno, Nev. 89502

[21] Appl. No.: 754,033

[22] Filed: Dec. 23, 1976

Related U.S. Application Data

[60] Continuation-in-part of Ser. No. 585,299, Jun. 9, 1975, Pat. No. 4,033,087, which is a division of Ser. No. 460,277, Apr. 12, 1974, Pat. No. 3,889,434.

[51] Int. Cl.[3] ..... E06B 7/12

[52] U.S. Cl. ..... 52/172; 52/399; 52/400; 52/656; 52/741; 52/788; 52/202

[58] Field of Search ..... 52/203, 202, 171, 172, 52/616, 398, 399, 400, 475, 656, 741; 49/479, 482

[56] References Cited

U.S. PATENT DOCUMENTS

| | | | |
|---|---|---|---|
| 2,794,221 | 6/1957 | Bedics | 49/479 |
| 2,834,999 | 5/1958 | Taylor et al. | 52/398 X |
| 3,782,054 | 1/1974 | Goss, Jr. | 52/656 X |
| 3,852,149 | 12/1974 | Sitter et al. | 52/616 |
| 3,919,821 | 11/1975 | Goetz | 52/616 X |
| 3,940,898 | 3/1976 | Kaufman | 52/616 X |
| 4,015,394 | 4/1977 | Kessler | 52/399 X |

*Primary Examiner*—Price C. Faw, Jr.
*Assistant Examiner*—Carl D. Friedman
*Attorney, Agent, or Firm*—Herbert C. Schulze

[57] ABSTRACT

This invention is a method and apparatus for performing such method whereby ordinary single glass building elements, such as windows, doors or the like are converted to double-walled, partially evacuated, thermally insulated elements by the use of a special adaptive method and special forming method, together with special adaptive elements in combination with sealant and desiccant materials.

2 Claims, 13 Drawing Figures

FIG. 1
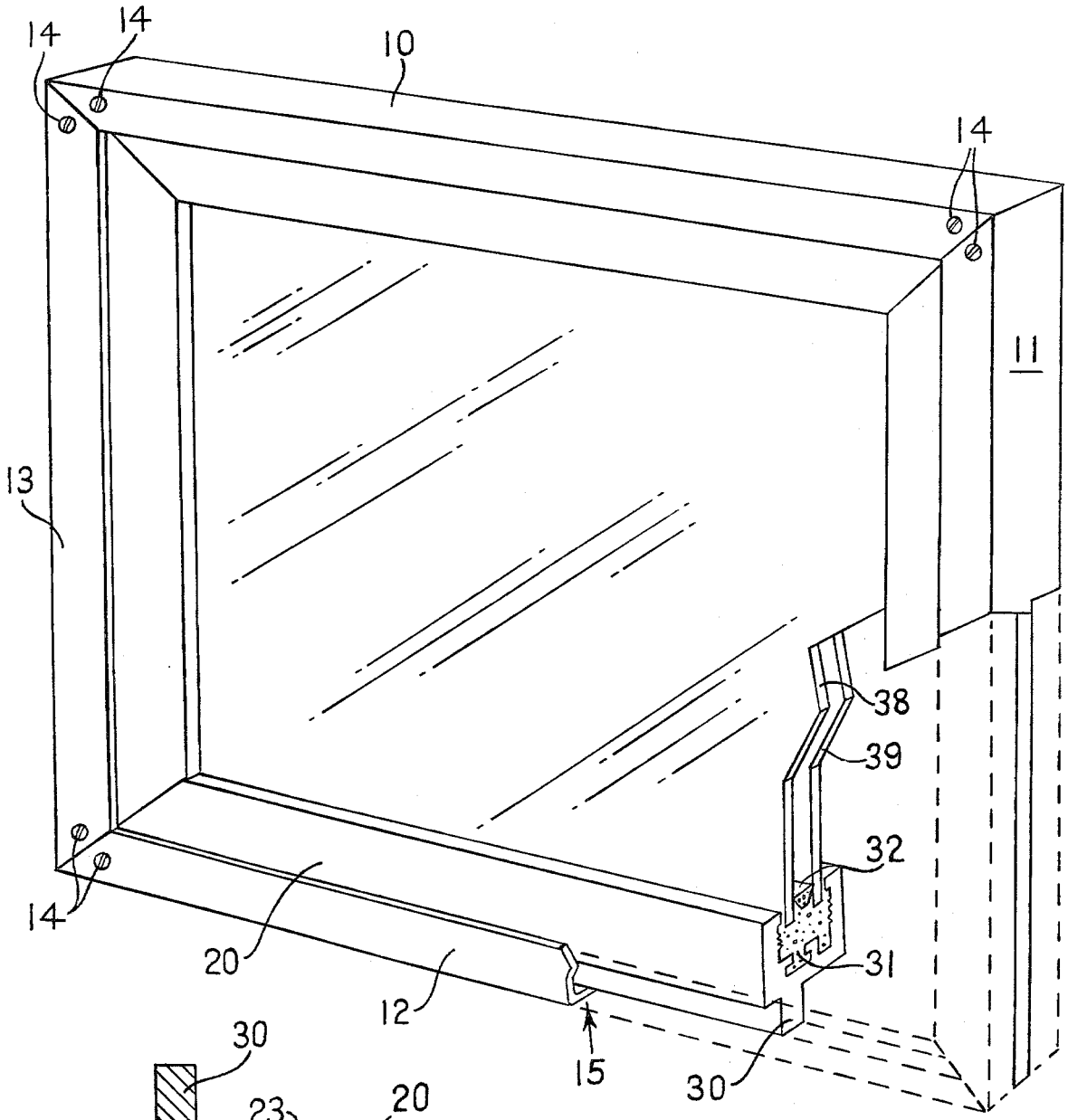
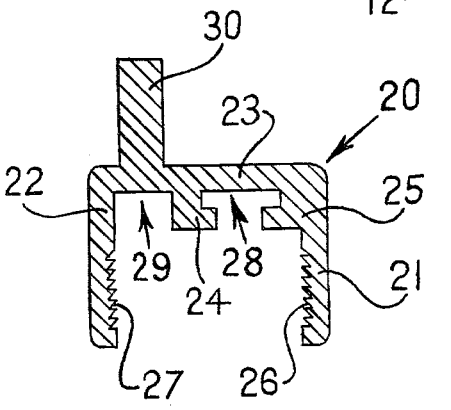
FIG. 2

FIG. 3
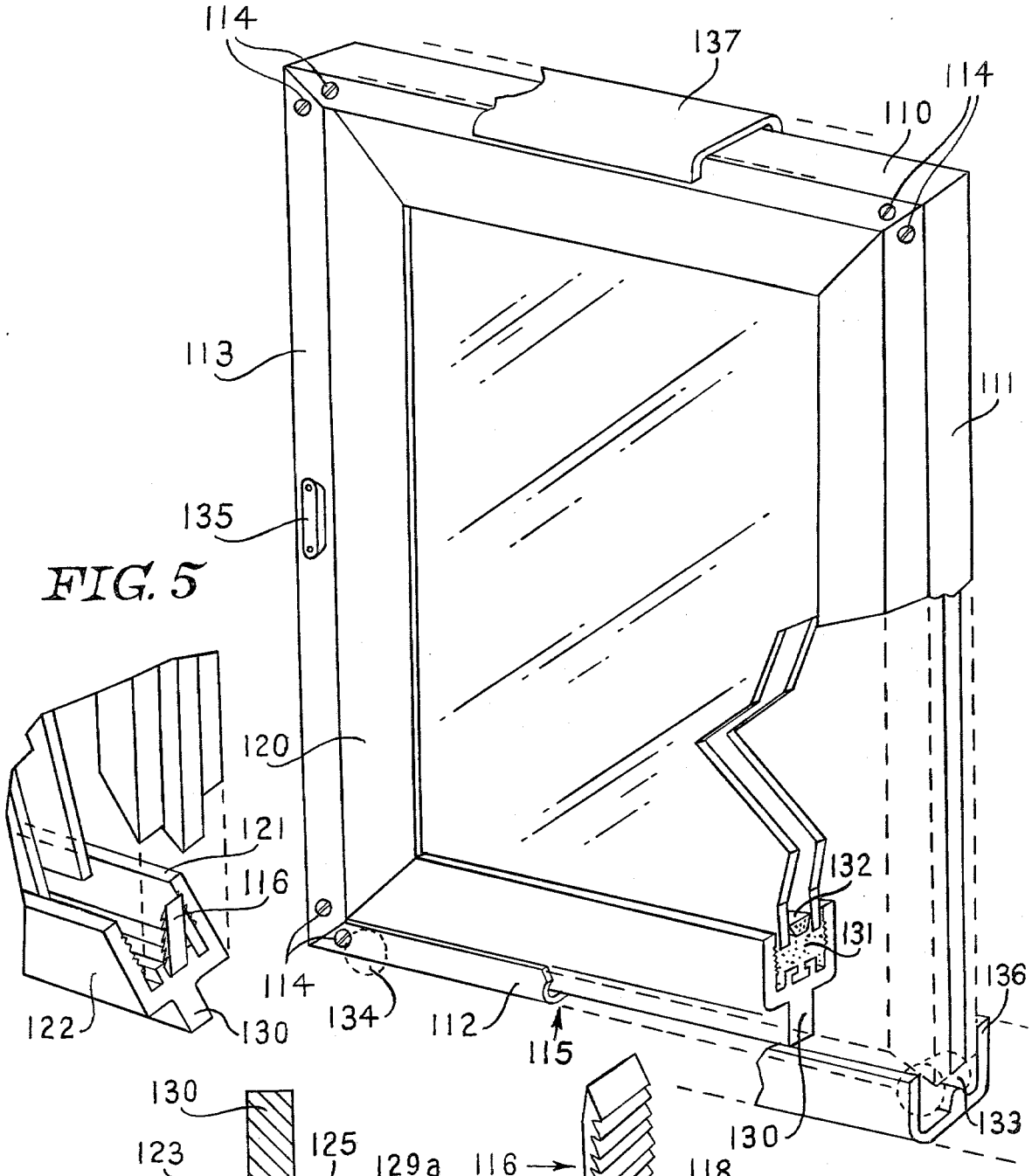
FIG. 5
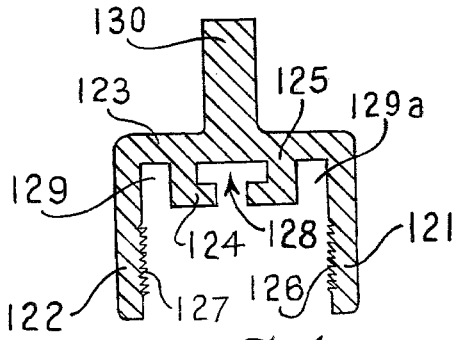
FIG. 4
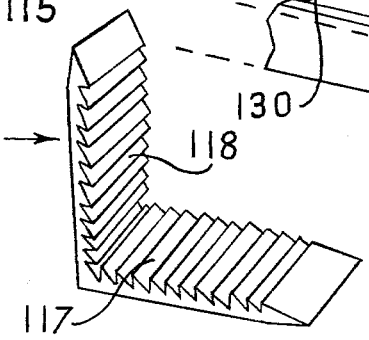
FIG. 6

FIG. 7
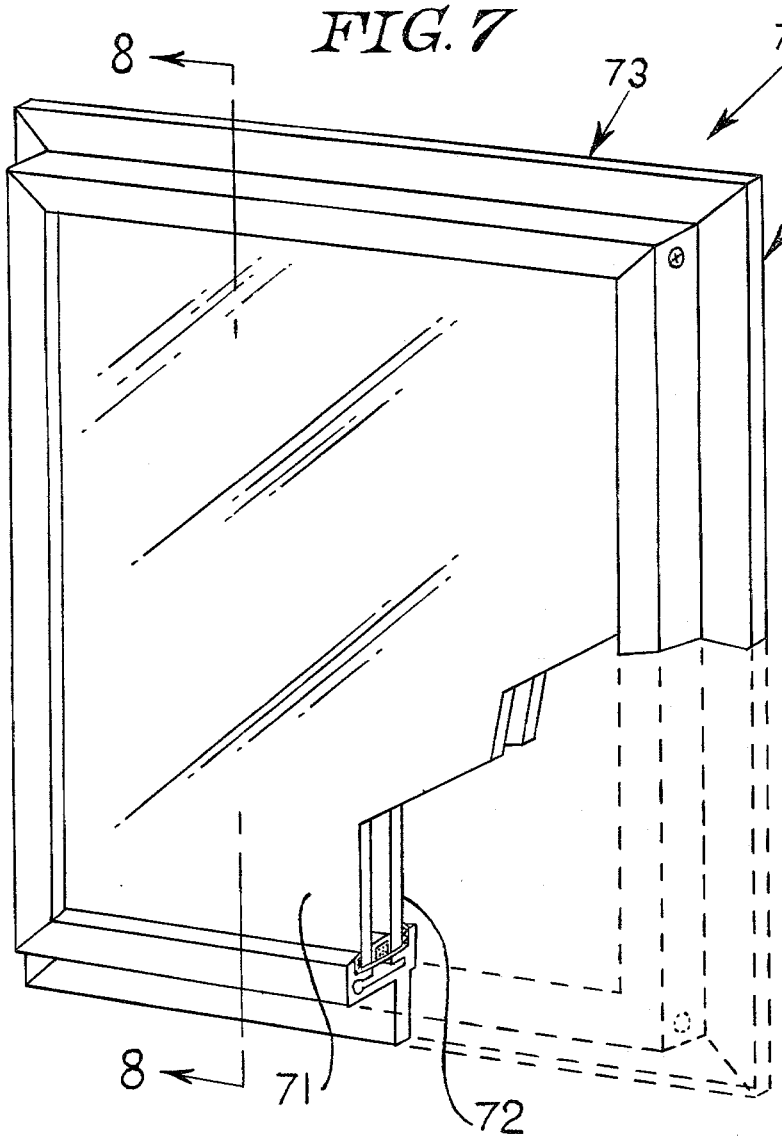
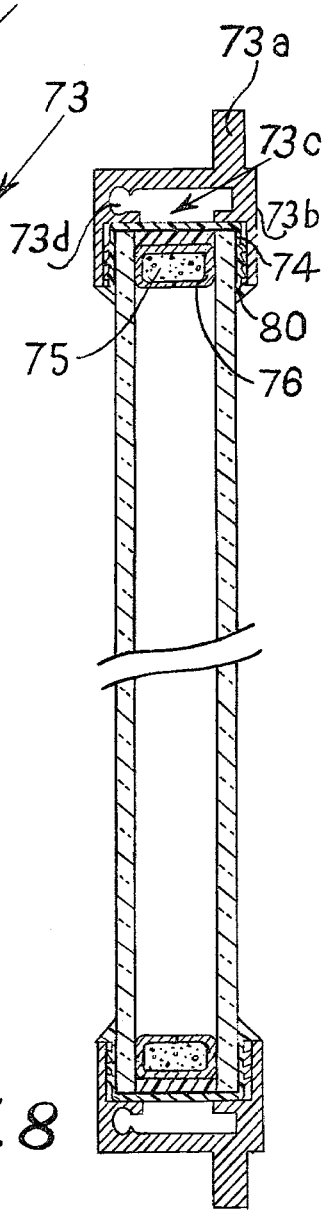
FIG. 8
FIG. 9
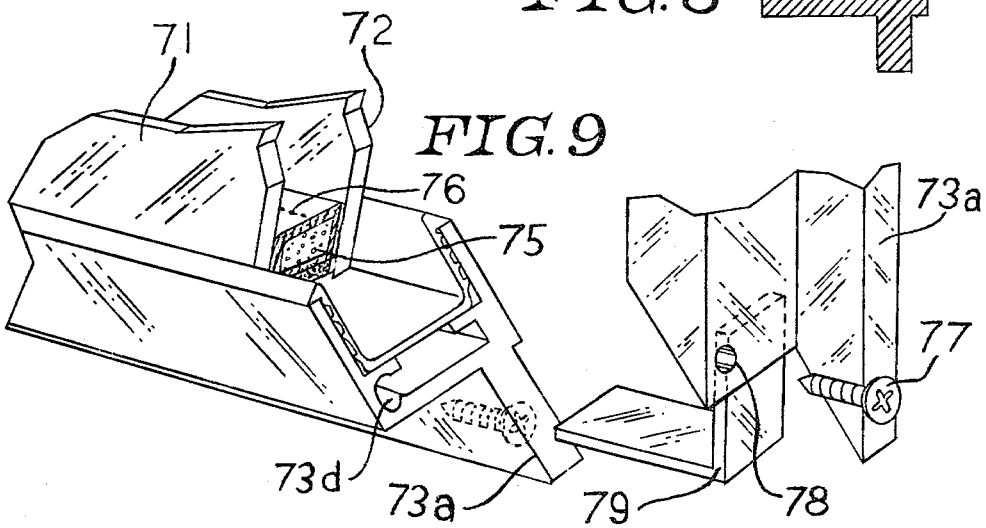

FIG. 10
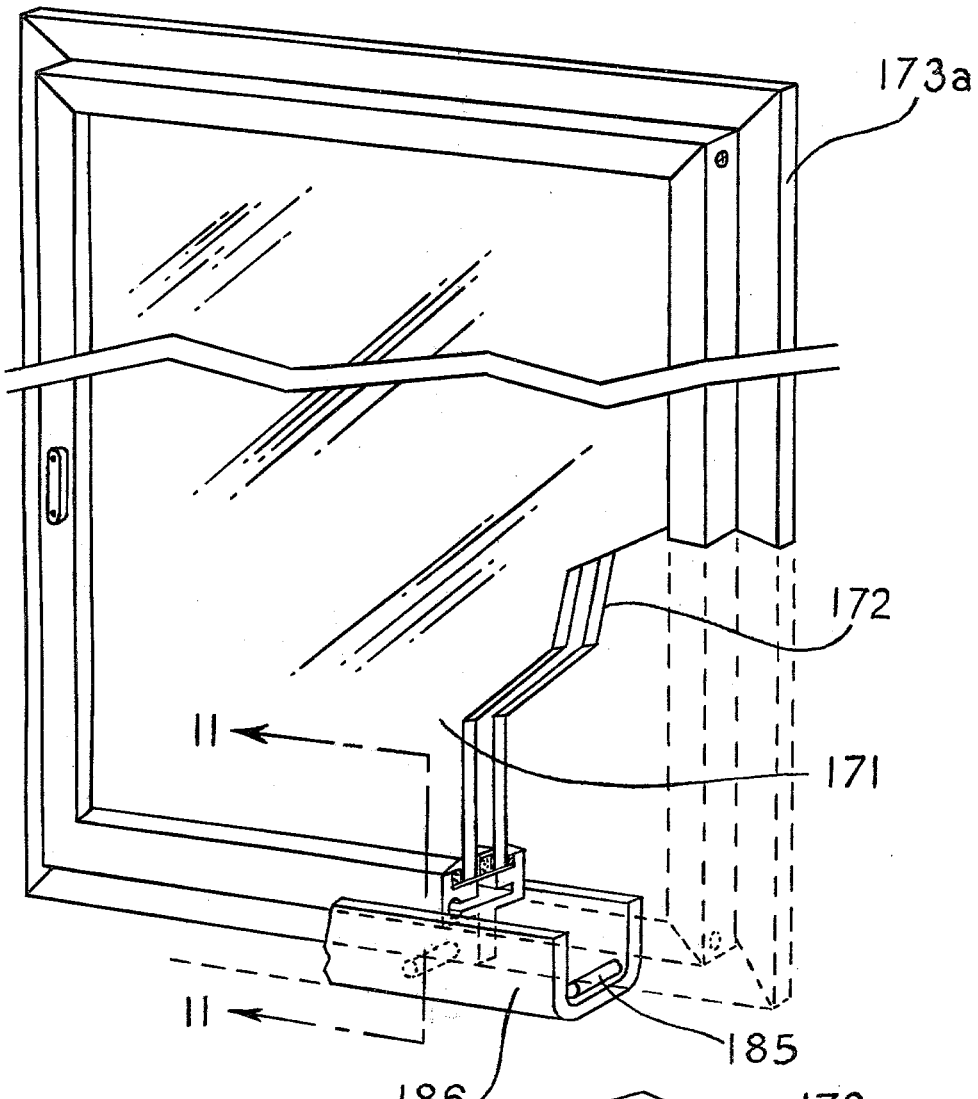
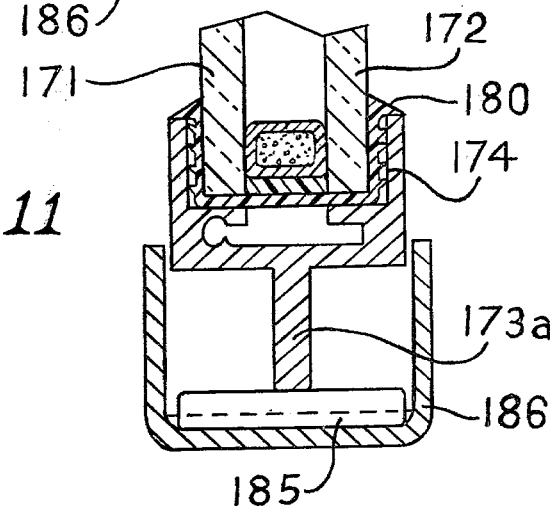
FIG. 11

THERMAL GLASS STRUCTURE AND METHOD FOR FORMING SAME

CROSS REFERENCE TO RELATED PATENT APPLICATIONS

This is a continuation in part of my presently pending patent application Ser. No. 585,299 filed June 9, 1975 entitled "THERMAL GLASS STRUCTURAL METHOD AND DEVICE" now U.S. Pat. No. 4,033,087, which, in turn, was a division of my application Ser. No. 460,277, filed Apr. 12, 1974 now U.S. Pat. No. 3,889,434.

BACKGROUND OF THE INVENTION

1. Field of the Invention

This invention is in the general field of insulated, or reduced thermally conductive, building elements, and more particularly building elements of glass, such a windows, doors and the like. It is further more particularly directed to double walled glass elements having a space between them to reduce conductivity through the glass elements of energy waves, most particularly, sound, and heat waves.

2. Description of the Prior Art

It is known to manufacture building elements with double walled, and insulated characteristics for purpose of reducing transfer of heat and sound. It is also known to construct such elements wherein the walls of the insulated item are formed of glass such as for windows, door, and the like. Such items are constructed in manufacturing locations; and control, proper fitting, relationship of the elements to one another, and the like, are accomplished under proper factory conditions with appropriate tooling and the like all of which is confining. Heretofore, it has not been possible to mount such elements in an existing door frame, window frames, and the like, which were previously constructed for single thickness glass elements. For the first time I have provided a method and apparatus for economical conversion of such old building elements to appropriately constructed elements which reduce the passage of thermal and sonic waves. This method also includes a special means for rapidly forming the double-walled elements utilizing a special sealant material, special spaces, and special plastic edge holding materials in a totally sealed relationship with metallic elements. In this sense there is no prior art relating to this unique method and combination.

With further reference to prior art, it is to be understood that I am familiar with my own issued U.S. Pat. No. 3,889,434 and the other patents cited as references therein, as well as all of the references cited in my copending patent application. The elements claimed in this particular application in the claims which follow, are believed to be unique as compared to all of the prior art referred to.

SUMMARY OF THE INVENTION

In all buildings and the like, the transfer of heat and sound through windows, doors, or other glass elements, is of major concern, and is particularly of great concern under the present conditions of restricted supplies of energy.

It is known that sound and heat are transmitted relatively readily through glass. It is also known that such transfer is materially inhibited wherein two thicknesses of glass are used with a space between containing either an insulating material, air, or some other gas. And, it is further known that maximum inhibition of the transmission of such waves is achieved wherein a vacuum is caused to exist between the thicknesses of glass. An ideal illustration of this phenomenon is the commonly known and widely used thermos bottle.

In recent years some effort has been directed towards the construction of windows, doors, and the like for buildings wherein two thicknesses of glass are utilized with a space containing air between them. A dramatic reduction of heat and sound transfer is achieved when such thicknesses are properly arranged within an appropriate frame, and properly sealed under controlled conditions.

Certain deficiencies occur when such installation of two thicknesses of glass is not perfect, in that admission of moisture laden air into the space between the glass elements may result in fogging making it difficult to see through the glass as well as causing an unsightly condition and staining on the interior of the glass. Also, such leakage will reduce the effectiveness of the insulation.

Attempts to insulate windows by adding an additional pane of glass have been unsuccessful and frustrating because of the numerous problems incurred, including the foregoing; and, also, the costs and difficulties of installation in a window sash originally designed for a single pane of glass or grate.

I have studied the construction of various types of windows utilizing single thicknesses of glass, and of doors and the like as well. I have finally conceived and developed a method by which old existing windows can be converted, at the site of the windows, to double-walled construction without deficiencies, and with great economy compared to factory constructed devices. Additionally, I have conceived and developed a method by which a partial vacuum is created between the panes, if desired, in order more effectively to inhibit the transfer of heat and sound and to enhance the quality of the installation.

In my method, I insert a special adapter element within the existing window frame and in lieu of the existing window pane. This adaptive element is so constructed so as to receive two like pieces of glass at a spaced distance from one another with provision for a sealing mastic as well as provision for deformative corner elements so as to insure permanent maintenance of the glass elements in the desired location and with appropriate protection against leakage at the mastic areas.

I have also provided a special method of removing moisture and causing a partial vacuum in the space between the glass elements wherein the air in such space is heated prior to final sealing, and an appropriate desiccant material is confined within an element in such manner that it will absorb all moisture in the space and within the heated air, thus insuring against steam and fog within the space and likewise causing a partial vacuum during the removal of the moisture from the air.

The desiccant material (such as silica gel or the like) is confined within a decorative element, which decorative element also acts as an appropriate spacer and locking device to maintain the glass elements in their desired respective locations.

Of importance, is the cooperative relationship between the adaptive elements, the corner connectors, and the desiccant containment element. And their overall relationship to appropriate sealant.

In the further development of this method, I have conceived and now reduced to practice an excellent and improved method of sealing the two panes of glass together, and fitting them in a cooperative relationship within an appropriate adaptor element. In accomplishing this new method, I first form the two panes of glass into a single unit by inserting the desiccant containing spacer element around the edges and between the two panes of glass, then forming a mastic sealant around the edges of the glass holding them firmly together, and holding the desiccant spacer device. Next, I take a specially extruded pliable material having gripping fins on its exterior edges and cut openings to accommodate the corners of the formed double-walled glass element as before described. This material is then placed upon and about the formed glass element and is then the material which comes in actual contact with the appropriate adaptive element.

Additionally, I have formed a special shape for the adaptive elements so that the corners can be held together with self tapping screws providing a more rigid frame than has been known before.

It is an object of this invention to provide a method and apparatus for converting a single pane window and the like to double pane elements;

Another object of this invention is to provide such a method and apparatus wherein the space between the panes is appropriately controlled and sealed from the outside atmosphere;

Another object of this invention is to provide a method and device as above described wherein moisture is removed from air in the space between the glass elements;

Another object of this invention is to provide a method and device as mentioned, wherein a partial vacuum may be accomplished in the space between the glass elements;

Another object of this invention is to provide a strong joint at the mitered corners of the frame by use of a self tapping metal screw; and, Another object of this invention is to provide a method for forming the double-walled glass element wherein a pliable liner is provided around the edges for contact with the adaptive elements.

The foregoing and other objects and advantages of this invention will become apparent to those skilled in the art upon reading the following description of a preferred embodiment in conjunction with the appended drawings.

BRIEF DESCRIPTION OF THE DRAWINGS

FIG. 1 is a partially broken-away perspective of a window constructed in accordance with a preferred embodiment of the method of this invention and showing the elements of preferred apparatus for performing the method;

FIG. 2 is an enlarged sectional view of the adaptive element in which the glass is mounted in the embodiment shown in FIG. 1;

FIG. 3 is a partially broken-away perspective of a glass door which has been converted by the method and apparatus of this invention;

FIG. 4 is an enlarged sectional view of the adaptive element in which the glass is mounted in the embodiment shown in FIG. 3;

FIG. 5 is a partially broken-away view of one of the mitered corners of the glass holding element of FIG. 3 with one piece lifted out of contact and twisted out of the way to illustrate particularly the utilization of a corner-holding bracket;

FIG. 6 is an enlarged perspective of the corner-holding bracket shown in FIG. 5;

FIG. 7 is a perspective of a double-walled window element using a modification of the adaptive element and utilizing the plastic extruded adapter;

FIG. 8 is a section on 8—8 of FIG. 7;

FIG. 9 is an enlarged, exploded, partially broken away view of the corner construction of the apparatus of FIG. 7;

FIG. 10 is a partially broken away perspective of an apparatus formed in a manner similar to that of FIG. 7, but with a different adaptive element for a different purpose;

FIG. 11 is an enlarged section on 11—11 of FIG. 10;

DESCRIPTION OF A PREFERRED EMBODIMENT

Figure 12:
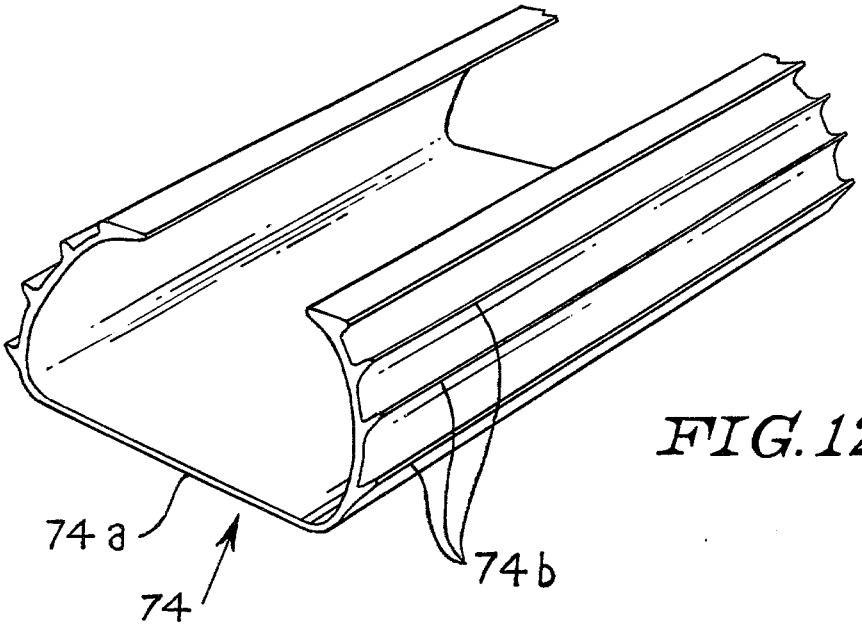
FIG. 12 is a perspective of a short piece of pliable extruded material utilized in the embodiments of FIGS. 7 and 10.

A preferred embodiment of a combination to practice this invention is illustrated in FIG. 1. Window panes are normally mounted in a suitable frame, such as an aluminum frame or the like, for fixed or movable installation in a wall. The frame illustrated in this case consists of a frame of customary construction, known in the art, the details of which are omitted, but which frame consists of four sides; 10, 11, 12 and 13. These elements may be connected together by suitable brackets or the like known in the art. In the case illustrated the sides are suitably fastened by screws or the like 14 adjacent the corners as indicated. Other constructions are known and this is not deemed in any manner critical.

Such frames as illustrated are normally constructed in such manner as to accommodate a pane of glass with suitable insulating strips about the edges of the glass, or the like. Such frames, therefore, have a relatively narrow opening therein, and are not in themselves susceptible of adaption to the mounting of double-walled insulating panes of glass therein.

I have invented a unique combination of two panes of glass, 38 and 39, mastic, sealing and installation material 31, moisture eliminating arrangement 32, and an adapter 20 to hold said two panes of glass, the mastic, and moisture eliminating materials. The adapter 20 fits within the ordinary window frames 10, 11, 12, and 13 configured so as to basically maintain the interior configuration of the window and yet to accommodate the extra width required in an unusual manner.

With attention directed to FIGS. 1 and 2, the unique adapter 1 provided is illustrated by the numeral 20 generally. The adapter 20 has an appropriate tongue or the like 30 running the length, such tongue being suitable to become engaged in the channel section 15 of each portion of the window frame, as shown in connection with portion 12 on FIG. 1.

As illustrated in FIG. 1, the two panes of glass 38 and 39 are secured within the adapter 20 by appropriate mastic, such as silicone or the like 31. As a combination spreader 4, (to maintain separation between the panes of glass) and as a moisture removal means (to remove moisture from between the two panes), a strip 32 essentially in the shape indicated (although this is not critical) is provided, which strip may be extruded of plastic, aluminum, or the like and is filled in its interior with a desicant such as silica gel or the like and will be appropriately perforated on the top so as to allow it to accept moisture from the space from between the panes of glass. Such a strip, containing desicant, is known in the art, and is utilized in some existing thermal double-walled installations. Details of such a desicant strip are known in the art and are not given here.

Turning attention now to FIG. 2, which is an enlarged sectional view of the adapter 20 without the silicone or the like 31, nor the panes of glass, nor the desicant strip, the unique combination will be particularly understood.

The adapter 20 is seen to consist of an essentially "U" shaped strip of rigid material such as aluminum, or the like, comprising a bottom segment 23 and two sides 21 and 22. The tongue 30 extends essentially as indicated from the bottom segment and is of appropriate size to fit the interior channel of the window frame. It is off-set to one side as indicated in such manner that when installed, the edge 22 will essentially conform to the interior of the window casing and will not substantially over-hang so as to create an unsightly or hazardous condition. The unusual shape of the tab 24 and the tab 25, creating the two pockets 28 and 29, allows the proper application of mastic sealing material so as to not only provide for the appropriate holding of the panes of glass, but, so as to provide appropriate expansion and contraction possibilities depending upon temperature conditions of the environment.

The scored edges 26 and 27 on the upper interior portions of edges 21 and 22 provide for the mastic to be held appropriately in that area and thus provide excellent wedging and holding action in the combination with the desicant strips 32.

In actually assembling the unit, and making the conversion from a single pane of glass, it is desirable, in the best form of the practice of this invention, to assemble in a reasonably heated area, or to provide sufficient heat to the materials as they are applied, so that the air space between the panes of glass 38 and 39 is as warm as reasonably possible. It is desirable that this air space is warmer than normal temperatures to be expected in the environment in which the window is installed. By this means, a vacuum condition is created within the space between the panes, depending upon the exact amount of applied heat, which vacuum condition results from the cooling and contraction of the air within the space is formed, together with the removal of moisture from said air, by the desicant strip 32, thus, and improved insulating barrier is created due to the inhibition of the travel of heat through the partially evacuated space.

FIGS. 3 and 4 illustrate an alternate embodiment of a device to practice the method of this invention, which has been more particularly designed for use in doors or the like. This is not necessarily limited to doors, but is particularly desirable in that application.

FIG. 3 illustrates a sliding glass door utilizing the methods of this invention and illustrating a preferred embodiment of the unique combination.

Sliding glass doors are well known in the art, and the particular construction shown here is in no manner deemed to be limiting in any respect. Normally, a sliding glass door will consist of a top and bottom frame, 110 and 112, with two edges 111 and 113. A door frame of this nature will normally be fastened at its corners with screws 114 or the like so as to complete a rectangular unit. Such unit normally will roll upon rollers 133 and 134 or the like within a track or the like 136 at its lower edge, and be guided by a top channel or the like 137. The door will normally have a handle 135 or the like.

Such glass door frame, normally, will have a channel as at 115 which will be of approximately appropriately width to carry a single panel of glass.

In practicing this invention, the glass normally within the door frame will be removed, and the tongue 130 of the adapter combination will be of such width as to appropriately fit within the customary door frame.

A pair of glass panels 138 and 139 will be held within the adapter unit, generally 120, by an appropriate silicone mastic material 131 and with the use of a desicant strip 132. It is understood that the strip 132 will perform a function similar to the strip 32 described with reference to FIG. 1, and the mastic material 131 will perform a similar function to the mastic material 31 described with reference to FIG. 1. For simplicity, the descriptions are not repeated, but are incorporated by this reference.

For practicing this embodiment, it is more particularly desired to center the adapter 120 within the door frame, since frequently there are obstructions such as screens or the like which may not have sufficient clearance to the door to enable an over-hanging unit such as was described.

With attention directed particularly to FIG. 4, which is an enlarged section of the adapter strip 120, it is seen that this consists of a strip of extruded aluminum or the like having two edges 122 and 121, together with a bottom element 123, with a tongue 130 depending from 123 in a direction opposed to the direction of edges 121 and 122. In this case the tongue 131 is approximately centered upon the edge 123.

The tabs 124 and 125, which provide pockets 128, 129, and **129*a*, in combination with such pockets will provide for the appropriate holding and expansion qualities of the sealant material 131 in conjunction with the use of the glass panels 138 and 139** so as to provide appropriate retention and sealing.

FIG. 5 illustrates a corner bracket which is generally used to provide additional stability to the corners of the adaptive elements. At the corner, the adaptive elements will normally be mitered essentially as indicated in FIG. 5. The pocket, or channel 128 has driven into it one leg of a bracket 116. The other leg extends at right angles and the mating adaptive element will be placed down upon it with the other leg of the corner bracket extending into the channel 128 appropriately, as will be understood. In the illustration of FIG. 5, the essentially horizontal adaptive element is seen to have the bracket 116 in place in its channel 128, and the mating adaptive element, being the vertical one in the illustration in FIG. 5 will be placed down upon the upstanding leg of the bracket 116 until it is fully inserted into the channel of the adaptive element.

FIG. 6 illustrates the typical corner bracket 116 having serrated edges on its interior 117 and 118 so shaped, as indicated, so as to grip the inner faces of the elements forming the channel 128. Normally the thickness of the corner bracket 116 will be such as to fit very snugly within the channel and thus be held firmly by the serrated edges 117 and 118.

It should be understood, that while not illustrated, a similar corner bracket will frequently be used in conjunction with the embodiment shown in FIGS. 1 and 2. It will be utilized in the same manner, and in the case of the embodiment shown in FIGS. 1 and 2, would be placed so as to grip within the channel pocket 28 in the adaptive element utilized in the embodiment of FIGS. 1 and 2.

The method of assembly, and the like, will be similar for the embodiment shown in FIGS. 3, 4, 5, and 6, to that described with reference to FIGS. 1 and 2, and will achieve essentially the same results. A complete description of the method is not given here since it would be repetitive and anyone skilled in the art will understand that exactly the same process will be followed.

With particular attention turned now to the illustrations of FIGS. 7, 8, and 9, a greatly improved and preferred embodiment and method is illustrated. In this embodiment, the complete window generally 70 is seen to be composed of two panes of glass 71 and 72 respectively, with the spacer and desiccant material 76 and 75 respectively.

The adaptive element 73 is seen to be composed of a generally u shaped element **73*b* with the depending element 73*a* suitable to fit into a standard window frame. The space 73*c* within the extrusion is provided to accommodate corner bracket 80. The construction is shwon in FIG. 9 particularly well. For additional holding strength, screw 77 is inserted through hole 78 on one frame element and is screwed into by self-tapping means known to those skilled in the art, the rounded opening at 73*d*** in the extrusion. The rounding of this portion has been of extreme significance since it was not possible to make a quick and easy strengthened corner until this particular thought was conceived.

The plastic extrusion 74 is of the nature of the material shown in detail in FIG. 12, and surrounds the two panes of glass as indicated, thus making a tight and secure fit within the adaptive element. Mastic, or the like, 80 is formed about the glass and the adaptive element and encloses the extruded pliable material 74 in the manner as shown to provide a waterproof and secure finished product.

With attention given to FIGS. 10 and 11, it is revealed how this same method and a slightly different apparatus can be used for sliding doors and the like. In this case, the adaptive element has its depending portion **173*a* depending as shown so that it can roll on rollers 185 within a frame 186** as may be desired.

The pliable extruded material 174 shown here will be of essentially the same construction and material as the material shown in FIG. 12 and described below.

It will be seen that the two panes of glass 171 and 172 are surrounded by the extruded material in a manner quite similar to that of the foregoing unit and has been sealed together with plastic material or the like, 180 in a similar manner.

Figure 13:
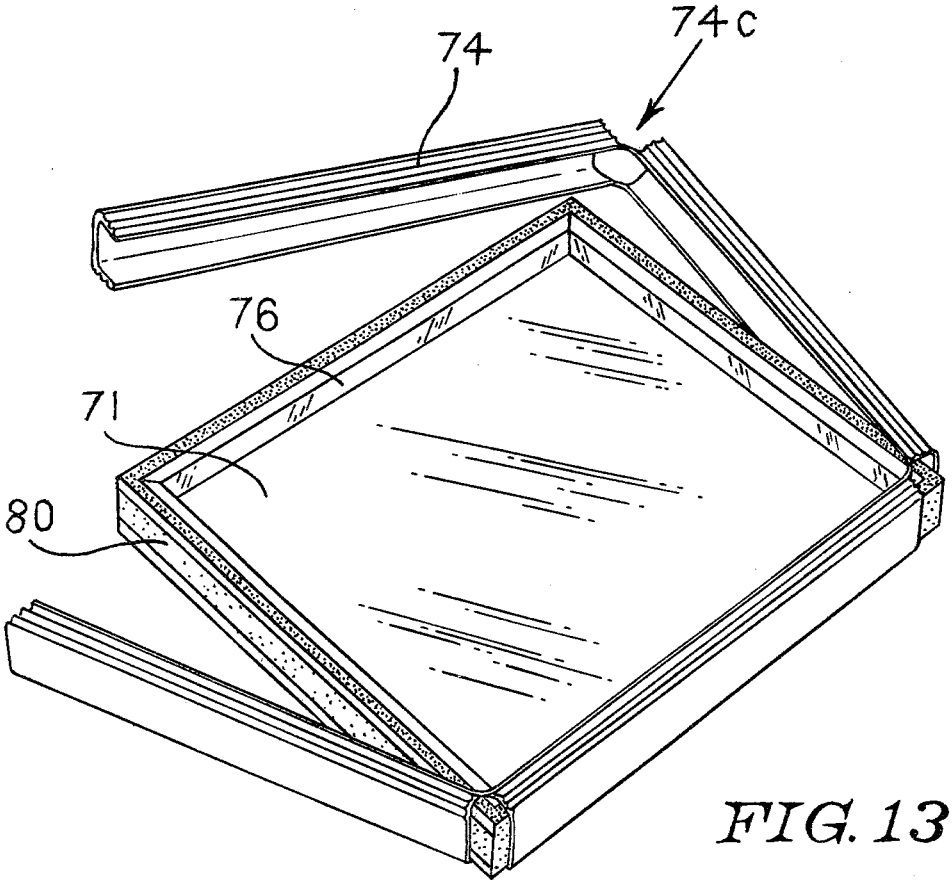
FIG. 13 is a perspective of an alternate method of assembly of the double-paned glass unit.

Turning finally to FIGS. 12 and 13, a preferred method of forming is now shown. It will be seen that the extruded pliable material (such as rubber, appropriate plastics, or the like) 74 is essentially in a u-shape with a flat portion **74*a* having no fins or the like, and fins 74*b* depending essentially as illustrated on the sides so that when it is placed within a frame so that it is obvious from FIGS. 7 through 11**, there will be a firm gripping action with enough resilience so that the glass will not be cracked, so that changes in temperature or the like will be compensated for.

In making this assembly, we have come upon the unique method as shown in FIG. 3 of cutting a slit at **74*c* so that the material forms readily about the same consisting of the panes of glass 71 and 72 with the desiccant material and spacer 76 and the mastic 80** formed in one piece originally.

While the embodiments of this invention shown and described are fully capable of achieving the objects and advantages desired, such embodiments have been illustrated solely for purposes of illustration and not for purposes of limitation.

I claim:

1. The method of forming a couble-walled thermally insulated window including: (1) Placing two rectangular panes of glass of the same size and shape upon a spacer containing desiccant material adjacent the edges of said panes of glass; (2) providing a coating of waterproof mastic about the edges of the panes of glass and the desiccant and spacing material so as to form one unit; (3) cutting a length of pliable material to the length which equals the length of all four edges of the rectangular unit as formed, and cutting three slits into said pliable material at those positions which will allow three corners of the said glass unit to protrude through said slits and wherein the slits are cut at such a distance that the fourth corner extends through the pliable material where the two cut ends of the pliable material are brought together, and placing said pliable material about the edges of said unit as formed; (4) placing adaptive elements of rigid material about said pliable material on each side of the unit; and (5) fastening the corners of the adaptive elements together.

2. A thermal glass structure, comprising, in combination: (1) two rectangular panes of glass of identical size and shape in an aligned, spaced apart relationship; (2) a spacer containing a desiccant about the perimeter of said panes of glass and between them; (3) a mastic about the perimeter of said panes of glass, between them, and joining them to said spacer; (4) a pliable, essentially "U" shaped binding about the outer edges of said panes and about the perimeter thereof, wherein there are three slits in said binding to allow three corners of the panes of glass to protrude there through, said slits being so spaced as to accommodate three corners with the two ends of the binding terminating at the fourth corner of the panes of glass, and (5) a rigid frame about the said pliable binding.

* * * * *